United States Patent [19]

Friedrich

[11] Patent Number: 4,735,825

[45] Date of Patent: Apr. 5, 1988

[54] METHOD OF APPLYING AND BONDING FREE-FLOWING BULB MATERIAL TO ARTIFICIAL GRASS

[75] Inventor: Hans J. Friedrich, Auenwald, Fed. Rep. of Germany

[73] Assignee: J. F. Adolff AG, Backang, Fed. Rep. of Germany

[21] Appl. No.: 73,857

[22] Filed: Jul. 15, 1987

Related U.S. Application Data

[63] Continuation of Ser. No. 709,627, Mar. 8, 1985, abandoned.

[30] Foreign Application Priority Data

Mar. 14, 1984 [DE] Fed. Rep. of Germany ..... 3409361

[51] Int. Cl.[4] ..... B05D 1/36

[52] U.S. Cl. ..... 427/202; 427/204; 428/17; 428/96

[58] Field of Search ..... 427/202, 204; 428/17, 428/95, 96, 97

[56] References Cited

U.S. PATENT DOCUMENTS

| | | | |
|---|---|---|---|
| 3,801,421 | 4/1974 | Allen et al. | 428/17 |
| 3,995,079 | 12/1974 | Haas, Jr. . | |
| 4,044,179 | 11/1975 | Haas, Jr. . | |
| 4,337,283 | 9/1980 | Haas, Jr. . | |
| 4,389,435 | 8/1981 | Haas, Jr. . | |
| 4,396,653 | 8/1983 | Tomarin | 428/17 |
| 4,444,815 | 6/1983 | Friedrich . | |

*Primary Examiner*—Marion C. McCamish

*Attorney, Agent, or Firm*—Neuman, Williams, Anderson & Olson

[57] ABSTRACT

The invention relates to an artificial grass, in particular for sports and playing areas, having a filling of free-flowing bulk material, in particular sand, provided between its pile threads such that the free ends of the pile threads project above the filling. According to the invention, the filling is fixed in relation to the pile threads by a bonding agent.

2 Claims, 1 Drawing Sheet

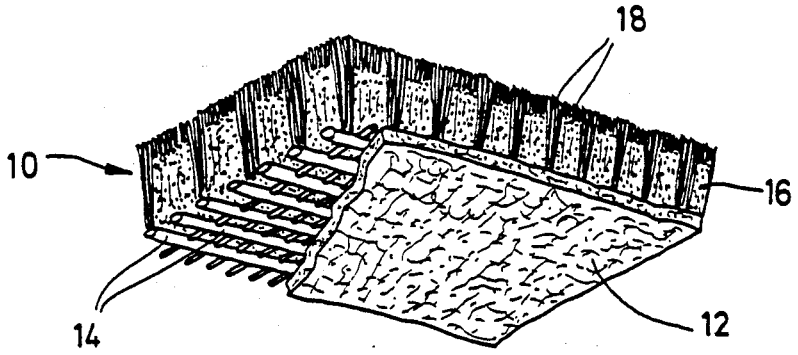
18
10
16
14
12

METHOD OF APPLYING AND BONDING FREE-FLOWING BULB MATERIAL TO ARTIFICIAL GRASS

This application is a continuation of application Ser. No. 709,627, filed Mar. 8, 1985, now abandoned.

The invention relates to an artifical grass, in particular for sports and playing areas, having a filling of free-flowing bulk material, in particular sand, provided between its pile threads such that the free ends of the pile threads project above the filling.

An artificial grass of this type is known, for example, from German laid-open paper 31 16 231. Other sand-filled artificial turfs are described in U.S. Pat. Nos. 3,995,079, 4,044,179, 4,389,435 and 4,337,283.

A common feature of known sand-filled grass or turf is the fact that, apart from a quite considerable compaction which may occur during use, i.e. when the artificial grass is used as a playing surface, and is generally undesired, the material of the filling is relatively freely displaceable in relation to the pile threads and that no bond exists either between the pile threads and the material of the filling or between the individual particles of the granular filling material.

The fact that the filler material has, up to now, been loosely spread between the pile threads of the grass makes it necessary, in accordance with the state of the art and when laying out a sports field or the like, to have the artificial grass layer first placed on a suitably prepared subsurface and then tensioned and secured and for the pile of the grass layer not to be filled with the filler material until the artificial grass is actually in place. The pile of the grass layer is then filled as follows. The free-flowing bulk material is spread over the artificial grass and brushed or swept into the pile. The brushes or sweepers hereby serve at the same time to level out the filler material in the pile of the grass and are used such that the free ends of the pile threads project to a greater or lesser extent above the surface of the filling.

The method previously used for producing a sand-filled artificial grass is disadvantageous in two respects. Firstly, the equipment used for spreading and levelling the filling must be available at the site of installation, particularly when the filling consists of a plurality of components which tend to separate and may, consequently, be distributed reliably throughout the pile of the artificial grass only with special equipment. Secondly, an even distribution of the filling outdoors may be impaired by even the slightest increase in humidity since the particles of the free-flowing bulk material then adhere to one another and/or to the pile threads and the spaces between the pile threads are, consequently, unevenly filled. For example, a slight moistening of the pile threads as a result of dew or mist is sufficient to prevent an even distribution and levelling of the filler material.

Proceeding on the basis of the state of the art, the object of the invention is to improve an artificial grass of the type described at the outset such that it may be laid at the site of installation irrespective of the weather conditions prevailing and without the need for special machinery and such that the filling has a uniform quality between the pile threads. A further object is to specify a method of producing such an improved artificial grass.

The object of improving the artificial grass is accomplished in accordance with the invention in that the filling is fixed in relation to the pile threads by a bonding agent.

It is an essential advantage of the inventive artificial grass that it may be finished completely, with the filling, at the production works where optimum operating conditions and machines are available. The filling is therefore guaranteed to be evenly distributed throughout the pile of the grass. As the filling is fixed by a bonding agent the grass can then be rolled up in a filled state and transported to the site where it is to be laid, either in a hall or outdoors.

As far as the method is concerned, the object is accomplished in that after the free-flowing bulk material has been distributed in the pile of the artificial grass it is fixed in relation to the pile threads by a bonding agent.

According to the invention, the bonding agent may be provided only on the surface of the filling of free-flowing bulk material in order to hold the material in place during transportation. In this respect, it is particularly advantageous for the bonding agent to be sprayed onto the surface of the filling. For this purpose, cellulose ether is, for example, particularly suitable. When the filled artificial grass is then laid, the bonding agent may be removed again, if required. It is therefore particularly favourable for a water-soluble bonding agent to be used for fixing the surface layer. Such water-soluble bonding agents include, for example, certain casein products which may be used to good advantage.

If, on the contrary, the material of the filling is intended to be permanently fixed in relation to the file threads, for example to counteract any separation of components during use or playing, it is advantageous in accordance with the invention to mix the bonding agent, in particular a water-insoluble bonding agent, with the free-flowing bulk material prior to the material being distributed in the pile of the grass layer and to activate the bonding agent at a later time, for example by heat treatment. In this respect, the following substances are preferred for use as water-insoluble bonding agents:

PVC powder, PET powder, melting fibres, aqueous synthetic resin dispersions or synthetic resin dispersions in solvent. These substances may be used individually or in suitable combinations.

Furthermore, various free-flowing bulk materials, such as cork, granulated rubber material, cork-like granulated plastics material, fibrous or powdery rubber material or textile fibre elements, may be used for a "sand-filled" grass or turf, according to the invention, in addition to or instead of sand, in particular dry sand.

It is also particularly advantageous, in accordance with the invention, for the filler material to be mixed with bonding agent in the case where the artificial grass is completed by providing the back with PVC plastics or latex, i.e. the primary backing of the grass is coated, at least in selected areas, for example along the distinct ribs of the primary backing of a raschel knitted material. In this case, completion of the back of the primary backing at a corresponding temperature causes the bonding agent to be activated at the same time and the free-flowing bulk material is bonded such that it is no longer displaceable and is fixed for a long time to the pile threads of the grass.

In addition, it has proven advantageous in development of the invention for the type and quantity of the bonding agent to be selected in relation to the type and dimensions of the filler material such that the bonding agent, which, as mentioned above, must possibly be activated first, permanently counteracts any compacting and/or separation of the components in the filler material. It is then no longer necessary to loosen and/or supplement the filling from time to time which is generally very difficult since the pile threads split durng use of an artificial grass, for example as a playing surface.

As also indicated above, the free-flowing bulk material of the filling according to the invention may be a granular material or a fibrous material, such as for example a fibrous rubber material such as that obtained by skiving rubber parts. The length and cross section of the fibres for the fibrous filler material are selected according to the relevant requirements. In this respect, as well as for selection of the particle size, care should be taken in the case of a granular filler material that this material can be brushed into the pile of the artificial grass.

In addition, it has proven advantageous in development of the invention for a water-insoluble bonding agent to be first mixed with a water-soluble component, in particular coarse-ground salt or another water-soluble, cheap salt, and for the mixture of bonding agent and water-soluble component then to be mixed with the material of the filling since the water-soluble component can, in this case, be washed out of the "sand-filled" grass again after activiation of the water-insoluble bonding agent. This will leave spaces which prevent the material of the filling becoming too compacted.

It has proven particularly advantageous for a filling consisting of 50% granulated rubber material, 25% coarse-grained salt and 25% polyethylene sintering powder to be brushed into the pile of the artificial grass. This type of filling is offered on the market, for example, by the Hoechst company under the type designation PE B 06. A mixture of this type is brushed into an artificial grass having pile threads of 24 mm in length and 300 stitches per meter in an amount of 5.5 kg/m$^2$.

Once the mixture has been distributed in the pile it is subjected to heat treatment at a temperture of about 135° C. for about 5 to 8 minutes. During this time, the sintering powder is sintered and a water-insoluble bonding agent structure is obtained. The water-soluble component of the mixture—in the embodiment salt—prevents the filling agglomerating in the region of its grains and is later washed out with water such that spaces are left amongst the granulated rubber material, the particles of which are bonded not only with one another but also with the pile threads by the water-insoluble bonding agent.

The invention will now be explaiend in more detail on the basis of the drawing, the single FIGURE showing a schematic perspective representation of a preferred embodiment of an artificial grass according to the invention, seen from below in three-quarter view.

The drawing shows in detail a section of a water-permeable artificial grass 10 with a filter mat 12 bonded to its underside. The filter mat 12 is bonded to the grass 10 in such a way that of the grid-like webs or ribs 14 of the backing for the grass 10 at least those ribs extending parallel to one another in one direction—in the embodiment the ribs shown in the drawing as running from left to right—are provided with a coating which allows the filter mat 12 to be bonded to the artificial grass, preferably by thermal heat-sealing. The filter mat 12 serves to prevent dirt particles passing upwards from the ground into the artificial grass.

The artificial grass 10 has pile threads 18 protruding upwards from the grid-like backing. These pile threads are often formed, in practice, of narrow plastic strips, especially when raschel knitted material is used for the grass 10, these strips normally being between about 18 and 36 mm in length or height.

According to the invention, a filling 16 of a free-flowing bulk material is fixed between the pile threads by a bonding agent. The type or granulation of the filler material is determined by the intended use of the artificial grass and by other factors such as whether the artificial grass is to be laid in a hall or outdoors. The bonding agent is also selected according to the use to which the grass is to be put. The bonding agent may be either a permanent one, which not only fixes the free-flowing bulk material in relation to the pile threads but also prevents any compacting of the material, or one which is only temporarily effective, in particular during transport only, such as for example a water-soluble bonding agent which is washed out of the free flowing bulk material again once the artificial grass has been laid on open ground. It has proven favourable for the proportion of bonding agent used to be at least about 25% by weight, the bonding agent preferably being a polyethylene powder having a particle size of 0 to 600 $\mu$m, preferably a powder for so-called whirl sintering or fluidized bed coating.

The depth of the filling 16 in an artificial grass according to the invention is selected such that the free ends of the pile threads 18 protrude above the surface of the filling 16 by a desired length, for example about 5 mm. The length, by which the free ends of the pile threads 18 protrude above the filling 16 in each individual case, is again selected according to the intended use of the artificial grass, its structure and with a view to the type and granulation of the filler material. For example, fillings consisting of granulated rubber material have a weight of between about 8 and 13 kg/m$^2$. The exact value in each individual case depends on the depth of the pile and the type of sport to be played.

What is claimed is:

1. A method of producing a pre-formed artificial grass including the steps of:

(a) mixing a free-flowing bulk material with a bonding agent, (b) distributing the resulting mixture of free-flowing bulk material and curable bonding agent between the upwardly projecting pile threads of a base mat as a filling whereby the pile threads project above said filling, and (c) subjecting said curable bonding agent, mat and filling to a curing condition for said bonding agent whereby said bonding agent secures said bulk material to said upwardly projecting threads and said artificial grass may be rolled after fabrication at a site of manufacture for transport to a site of use and unrolled at said site of use substantially without loss of said bulk material.

2. The method of claim 1 in which said free-flowing bulk material comprises sand.

* * * * *